US010932042B2

(12) United States Patent
Hirano et al.

(10) Patent No.: US 10,932,042 B2
(45) Date of Patent: Feb. 23, 2021

(54) CONVERSATION ASSIST APPARATUS AND CONVERSATION ASSIST METHOD

(71) Applicant: YAMAHA CORPORATION, Hamamatsu (JP)

(72) Inventors: Katsuya Hirano, Hamamatsu (JP); Tsuyoshi Okami, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/895,551

(22) Filed: Jun. 8, 2020

(65) Prior Publication Data

US 2020/0304909 A1 Sep. 24, 2020

Related U.S. Application Data

(60) Division of application No. 16/367,930, filed on Mar. 28, 2019, now Pat. No. 10,812,901, which is a (Continued)

(30) Foreign Application Priority Data

Sep. 30, 2016 (JP) ..... JP2016-192952
Nov. 29, 2016 (JP) ..... JP2016-231609

(51) Int. Cl.
*H04R 3/00* (2006.01)
*H04R 1/40* (2006.01)

(Continued)

(52) U.S. Cl.
CPC ..... *H04R 3/005* (2013.01); *G10L 21/0232* (2013.01); *H04R 1/403* (2013.01);

(Continued)

(58) Field of Classification Search
None
See application file for complete search history.

(56) References Cited

U.S. PATENT DOCUMENTS

2010/0166212 A1* 7/2010 Ishibashi ..... H04R 1/403 381/92
2016/0029111 A1* 1/2016 Wacquant ..... H04R 3/005 381/71.4

(Continued)

FOREIGN PATENT DOCUMENTS

JP S58114554 A 7/1983
JP S61108288 A 5/1986

(Continued)

OTHER PUBLICATIONS

Office Action issued in Japanese Appln. No. 2016-231609 dated Jul. 14, 2020. English machine translation provided.

(Continued)

*Primary Examiner* — Kenny H Truong
(74) *Attorney, Agent, or Firm* — Rossi, Kimms & McDowell LLP

(57) ABSTRACT

A conversation assist apparatus for a vehicle that includes a plurality of microphones and a plurality of electric loudspeakers, each microphone of the plurality of microphones and each electric loudspeaker of the plurality of loudspeakers being arranged so as to correspond to a seat of four seats arranged in a rectangular manner in a passenger compartment of the vehicle includes a signal processor configured to generate an audio signal by adding a delay to an output signal of a microphone of the plurality of microphones; a supplier configured to supply the generated audio signal to an electric loudspeaker of the plurality of electric loudspeakers that corresponds to a diagonal seat, from among the four seats, that is located at a diagonal position of a seat corre- (Continued)

sponding to the microphone; and a controller configured to control an amount of the delay based on a state of the vehicle.

3 Claims, 12 Drawing Sheets

Related U.S. Application Data continuation of application No. PCT/JP2017/034010, filed on Sep. 21, 2017.

(51) Int. Cl.
*G10L 21/0232* (2013.01)
*H04R 3/02* (2006.01)
*H04R 3/12* (2006.01)

(52) U.S. Cl.
CPC ..... *H04R 1/406* (2013.01); *H04R 3/02* (2013.01); *H04R 3/12* (2013.01); *H04R 2499/13* (2013.01)

(56) References Cited

U.S. PATENT DOCUMENTS

| | | | |
|---|---|---|---|
| 2018/0191911 | A1 | 7/2018 | Matsui |
| 2019/0251948 | A1 | 8/2019 | Hayashi |

FOREIGN PATENT DOCUMENTS

| | | | |
|---|---|---|---|
| JP | S6185995 | U | 6/1986 |
| JP | H0730994 | A | 1/1995 |
| JP | H11342799 | A | 12/1999 |
| JP | 2002051392 | A | 2/2002 |
| JP | 2003125068 | A | 4/2003 |
| JP | 2005161873 | A | 6/2005 |
| JP | 2008042390 | A | 2/2008 |
| JP | 2010124435 | A | 6/2010 |
| JP | 2011253129 | A | 12/2011 |
| JP | 2015071320 | A | 4/2015 |
| JP | 2016063439 | A | 4/2016 |
| JP | 2016072797 | A | 5/2016 |

OTHER PUBLICATIONS

Office Action issued in Chinese Appln. No. 201780057957.1 dated Jun. 30, 2020. English translation provided.
International Search Report issued in Intl. Appln. No. PCT/JP2017/034010 dated Dec. 19, 2017. English translation provided.
Written Opinion issued in Intl. Appln. No. PCT/JP2017/034010 dated Dec. 19, 2017.
Office Action issued in Japanese Appln. No. 2016-192952 dated Mar. 10, 2020. English machine translation provided.
Office Action issued in U.S. Appl. No. 16/367,930 dated Jan. 9, 2020.
Notice of Allowance issued in U.S. Appl. No. 16/367,930 dated May 19, 2020.

* cited by examiner

CONVERSATION ASSIST APPARATUS AND CONVERSATION ASSIST METHOD

CROSS REFERENCE TO RELATED APPLICATIONS

This application is a Continuation Application of PCT Application No. PCT/JP2017/034010, filed Sep. 21, 2017, and is based on and claims priority from Japanese Patent Application No. 2016-192952, filed Sep. 30, 2016, and Japanese Patent Application No. 2016-231609, filed Nov. 29, 2016, the entire contents of each of which are incorporated herein by reference.

BACKGROUND

Technical Field

This disclosure relates to a technique for assisting a conversation.

Description of Related Art

Japanese Patent Application Laid-Open Publication No. 2002-51392 (hereafter, JP 2002-51392) discloses an in-vehicle conversation assist apparatus for assisting a conversation in a vehicle. The in-vehicle conversation assist apparatus includes multiple microphones and electric loudspeakers corresponding to four seats arranged in a rectangular manner. In the in-vehicle conversation assist apparatus, the conversation voice output level from each electric loudspeaker is adjusted such that human speaker's voice is heard as if it comes from the vicinity of the human speaker's seat.

With regard to the in-vehicle conversation assist apparatus disclosed in JP 2002-51392, there may be a situation in which the sound output from electric loudspeakers is difficult to hear.

SUMMARY

In view of the above, an object is to provide a technique that can restrict occurrence of the situations in which the sound output from electric loudspeakers is difficult to hear.

In one aspect, a conversation assist apparatus for a vehicle that includes a plurality of microphones and a plurality of electric loudspeakers, each microphone of the plurality of microphones and each electric loudspeaker of the plurality of loudspeakers being arranged so as to correspond to a seat of four seats arranged in a rectangular manner in a passenger compartment of the vehicle may include: a signal processor configured to generate an audio signal by adding a delay to an output signal of a microphone of the plurality of microphones; a supplier configured to supply the generated audio signal to an electric loudspeaker of the plurality of electric loudspeakers that corresponds to a diagonal seat, from among the four seats, that is located at a diagonal position of a seat corresponding to the microphone; and a controller configured to control an amount of the delay based on a state of the vehicle.

In another aspect, a conversation assist apparatus for a vehicle that includes a plurality of microphones and a plurality of electric loudspeakers, each microphone of the plurality of microphones and each electric loudspeaker of the plurality of loudspeakers being arranged so as to correspond to a seat of four seats arranged in a rectangular manner in a passenger compartment of the vehicle may include a signal processor configured to generate an audio signal based on an output signal of a microphone of the plurality of microphones; and a supplier configured to switch, upon reception of a howling (feedback) noise occurrence signal indicative of occurrence of a howling noise, a destination of the generated audio signal from an electric loudspeaker of the plurality of loudspeakers that is a current destination of the generated audio signal to another electric loudspeaker of the plurality of electric loudspeakers that is different from the electric loudspeaker that is the current destination of the generated audio signal.

In another aspect, a conversation assist apparatus for a vehicle that includes a plurality of microphones and a plurality of electric loudspeakers, each microphone of the plurality of microphones and each electric loudspeaker of the plurality of loudspeakers being arranged so as to correspond to a seat of four seats arranged in a rectangular manner in a passenger compartment of the vehicle may include: a signal processor configured to generate respective audio signals based on respective output signals of respective microphones of the plurality of microphones; and a supplier configured to supply each audio signal of the generated respective audio signals to a respective electric loudspeaker of the plurality of electric loudspeakers corresponding to a respective diagonal seat, from among the four seats, that is located at a diagonal position of a respective seat corresponding to the respective microphone.

DESCRIPTION OF EMBODIMENTS

Figure 1:
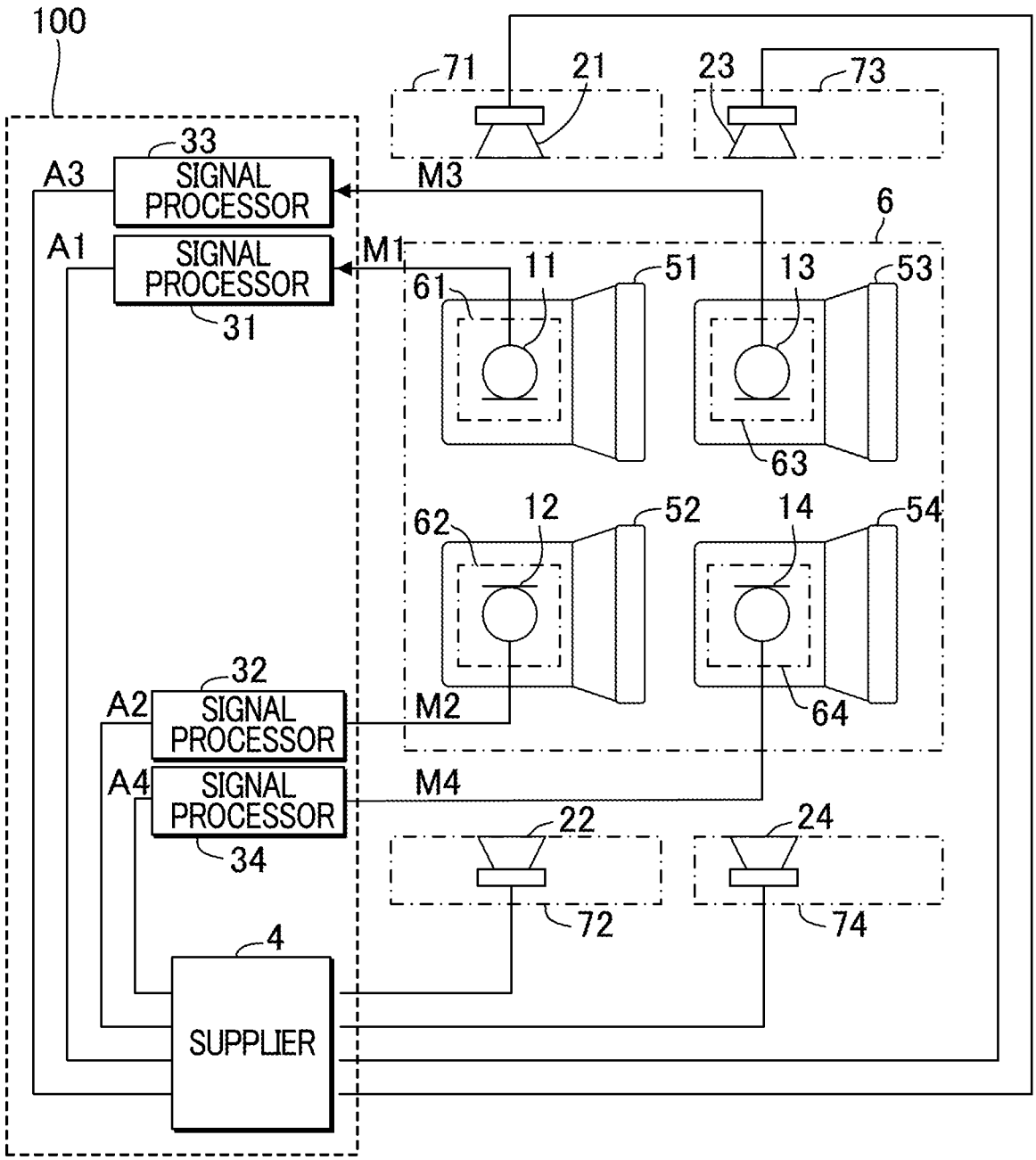
FIG. 1 is a diagram showing a conversation assist apparatus 100 according to a first embodiment.

With reference to the accompanying drawings, an embodiment will be described. In the drawings, the dimensions of each element are not necessarily to scale. The embodiments described below are preferable specific examples so that the present embodiment includes technically preferable limitations. However, the scope of the present disclosure is not limited to the embodiments unless stated otherwise in the following description.

First Embodiment

FIG. 1 is a diagram showing a conversation assist apparatus 100 according to a first embodiment. In the example shown in FIG. 1, the conversation assist apparatus 100 is used in a vehicle. In the space that is an example of the interior of the vehicle, four seats 51 to 54 arranged in an rectangular manner, a ceiling 6, a front right door 71, a front left door 72, a rear right door 73, a rear left door 74, microphones 11 to 14, and electric loudspeakers 21 to 24 are arranged in addition to the conversation assist apparatus 100. The seat 51 is the driver's seat, and the seat 52 is the front passenger seat. The seat 53 is the rear right seat, whereas the seat 54 is the rear left seat. Each of the seats 51 to 54 is formed from components made of cloth or leather, and can absorb sound. The seats 51 to 54 are oriented in the same direction.

The conversation assist apparatus 100 includes signal processors 31 to 34 and a supplier 4.

Each of the microphones 11 to 14 outputs an output signal corresponding to the sound that is received. The microphone 11 is located corresponding to the seat 51. In the example shown in FIG. 1, the microphone 11 is located in a region 61 of the ceiling 6 that faces the seating surface of the seat 51. The microphone 12 is located corresponding to the seat 52. In the example shown in FIG. 1, the microphone 12 is located in a region 62 of the ceiling 6 that faces the seating surface of the seat 52. The microphone 13 is located corresponding to the seat 53. In the example shown in FIG. 1, the microphone 13 is located in a region 63 of the ceiling 6 that faces the seating surface of the seat 53. The microphone 14 is located corresponding to the seat 54. In the example shown in FIG. 1, the microphone 14 is located in a region 64 of the ceiling 6 that faces the seating surface of the seat 54.

The electric loudspeaker 21 is located corresponding to the seat 51. In the example shown in FIG. 1, the electric loudspeaker 21 is installed in the front right door 71 located at the side of the seat 51. The electric loudspeaker 22 is located corresponding to the seat 52. In the example shown in FIG. 1, the electric loudspeaker 22 is installed in the front left door 72 located at the side of the seat 52. The electric loudspeaker 23 is located corresponding to the seat 53. In the example shown in FIG. 1, the electric loudspeaker 23 is installed in the rear right door 73 located at the side of the seat 53. The electric loudspeaker 24 is located corresponding to the seat 54. In the example shown in FIG. 1, the electric loudspeaker 24 is installed in the rear left door 74 located at the side of the seat 54.

The signal processor 31 generates an audio signal A1 on the basis of the output signal M1 of the microphone 11. The signal processor 31 generates the audio signal A1, by, for example, adding a delay to the output signal M1 and amplifying the delayed output signal M1. The signal processor 32 generates an audio signal A2 on the basis of the output signal M2 of the microphone 12. The signal processor 32 generates the audio signal A2, by, for example, adding a delay to the output signal M2 and amplifying the delayed output signal M2. The signal processor 33 generates an audio signal A3 on the basis of the output signal M3 of the microphone 13. The signal processor 33 generates the audio signal A3, by, for example, adding a delay to the output signal M3 and amplifying the delayed output signal M3. The signal processor 34 generates an audio signal A4 on the basis of the output signal M4 of the microphone 14. The signal processor 34 generates the audio signal A4, by, for example, adding a delay to the output signal M4 and amplifying the delayed output signal M4.

The supplier 4 is signal supply circuitry, for example. The supplier 4 supplies the audio signal A1 to the speaker 24 corresponding to the seat (diagonal seat) 54 located at the diagonal position of the seat 51 corresponding to the microphone 11. The supplier 4 supplies the audio signal A2 to the speaker 23 corresponding to the seat (diagonal seat) 53 located at the diagonal position of the seat 52 corresponding to the microphone 12. The supplier 4 supplies the audio signal A3 to the speaker 22 corresponding to the seat (diagonal seat) 52 located at the diagonal position of the seat 53 corresponding to the microphone 13. The supplier 4 supplies the audio signal A4 to the speaker 21 corresponding to the seat (diagonal seat) 51 located at the diagonal position of the seat 54 corresponding to the microphone 14. Thus, the conversation assist apparatus 100 outputs a conversation voice received by a microphone from an electric loudspeaker that is remote from the microphone, for assisting conversation, such that a passenger can easily hear another passenger's conversation voice.

Figure 2:
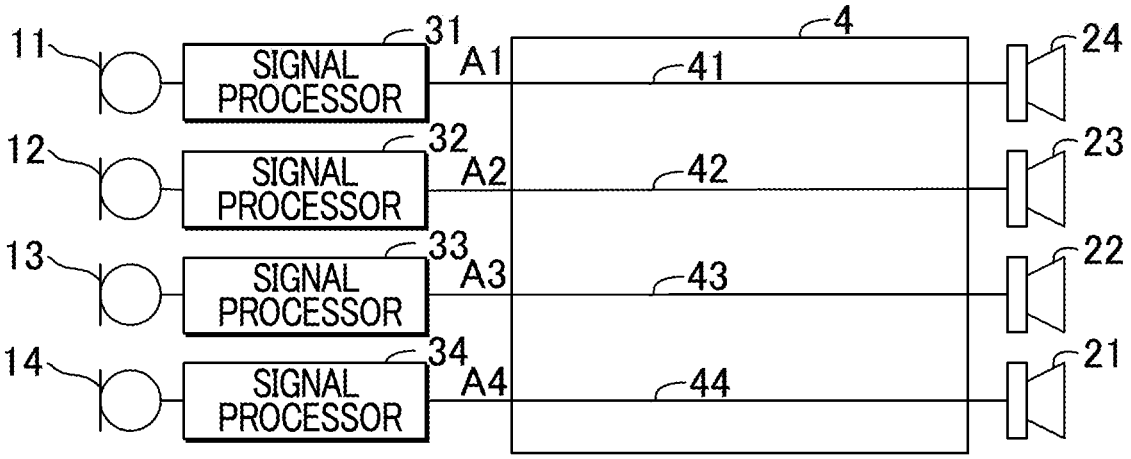
FIG. 2 is a diagram showing an example of a supplier 4.

FIG. 2 is a diagram showing an example of the supplier 4. The supplier 4 shown in FIG. 2 includes a wire 41 that electrically connects the signal processor 31 and the electric loudspeaker 24, a wire 42 that electrically connects the signal processor 32 and the electric loudspeaker 23, a wire 43 that electrically connects the signal processor 33 and the electric loudspeaker 22, and a wire 44 that electrically connects the signal processor 34 and the electric loudspeaker 21.

The audio signal A1 is supplied through the wire 41 to the electric loudspeaker 24. The electric loudspeaker 24 outputs a sound corresponding to the audio signal A1 (sound corresponding to the output signal M1 of the microphone 11). The audio signal A2 is supplied through the wire 42 to the electric loudspeaker 23. The electric loudspeaker 23 outputs a sound corresponding to the audio signal A2 (sound corresponding to the output signal M2 of the microphone 12). The audio signal A3 is supplied through the wire 43 to the electric loudspeaker 22. The electric loudspeaker 22 outputs a sound corresponding to the audio signal A3 (sound corresponding to the output signal M3 of the microphone 13). The audio signal A4 is supplied through the wire 44 to the electric loudspeaker 21. The electric loudspeaker 21 outputs a sound corresponding to the audio signal A4 (sound corresponding to the output signal M4 of the microphone 14).

According to this embodiment, it is possible to supply an audio signal to the electric loudspeaker which is the most distant from the microphone outputting the output signal that is the origin of the audio signal, from among the electric loudspeakers 21 to 24 located corresponding to respective seats. Howling noise is likely to occur when the output of an amplifier is positively fed back to the input of the amplifier in a situation in which the microphone receives the sound output from the electric loudspeaker. When the electric loudspeaker furthest away from the microphone outputs a sound, the sound output from the electric loudspeaker reaches the microphone with attenuation greater than attenuation in the sound output from other electric loudspeakers. Therefore, it is possible to reduce the probability of occurrence of howling noise during conversation, thus making it easier to hear the sound output from the electric loudspeaker.

Furthermore, since a seat (in particular, the seat back) is interposed between the microphone that outputs the output signal and the electric loudspeaker to which the audio signal is supplied, the sound output from the electric loudspeaker is likely to be absorbed by the seat. As a result, it is possible to reduce the probability of occurrence of howling noise.

It is known that a human voice is difficult to understand in a case in which the time interval between syllables is longer. Accordingly, if a reverberation is imparted to the voice uttered by a human speaker, the time interval between syllables will be small. Therefore, the sound uttered by the human speaker will be easy for the listener to hear. Since each of the seats 51 to 54 has a sound absorbing property, reverberation of the voice uttered by the human speaker is smaller than reverberation in a case in which there are no seats 51 to 54. Accordingly, compared to the case in which the seats 51 to 54 do not exist, the time interval between syllables may be greater in the voice uttered by the human speaker, and hence the voice is difficult for the listener to hear. However, according to this embodiment, a delay is added to the output signal of each of the microphones 11 to 14 to generate an audio signal. The sound output from each of the electric loudspeakers 21 to 24 in response to the audio signal serves as a reverberation of the voice spoken by the human speaker. Therefore, compared with the case in which no delay is added to the output signal of each of the microphones 11 to 14, the time interval between syllables can be made small, thereby reducing the probability that the sound is difficult for the listener to hear. In addition, the human speaker can listen to the voice output from the electric loudspeaker that is delayed from the human speaker's voice, and can monitor the voice of the human speaker himself. However, it is also possible to not add the delay by setting (setting the delay time to zero).

Second Embodiment

In the first embodiment, the destinations of the audio signals A1 to A4 are fixed. In a second embodiment, the destinations of the audio signals A1 to A4 can be varied.

Figure 3:
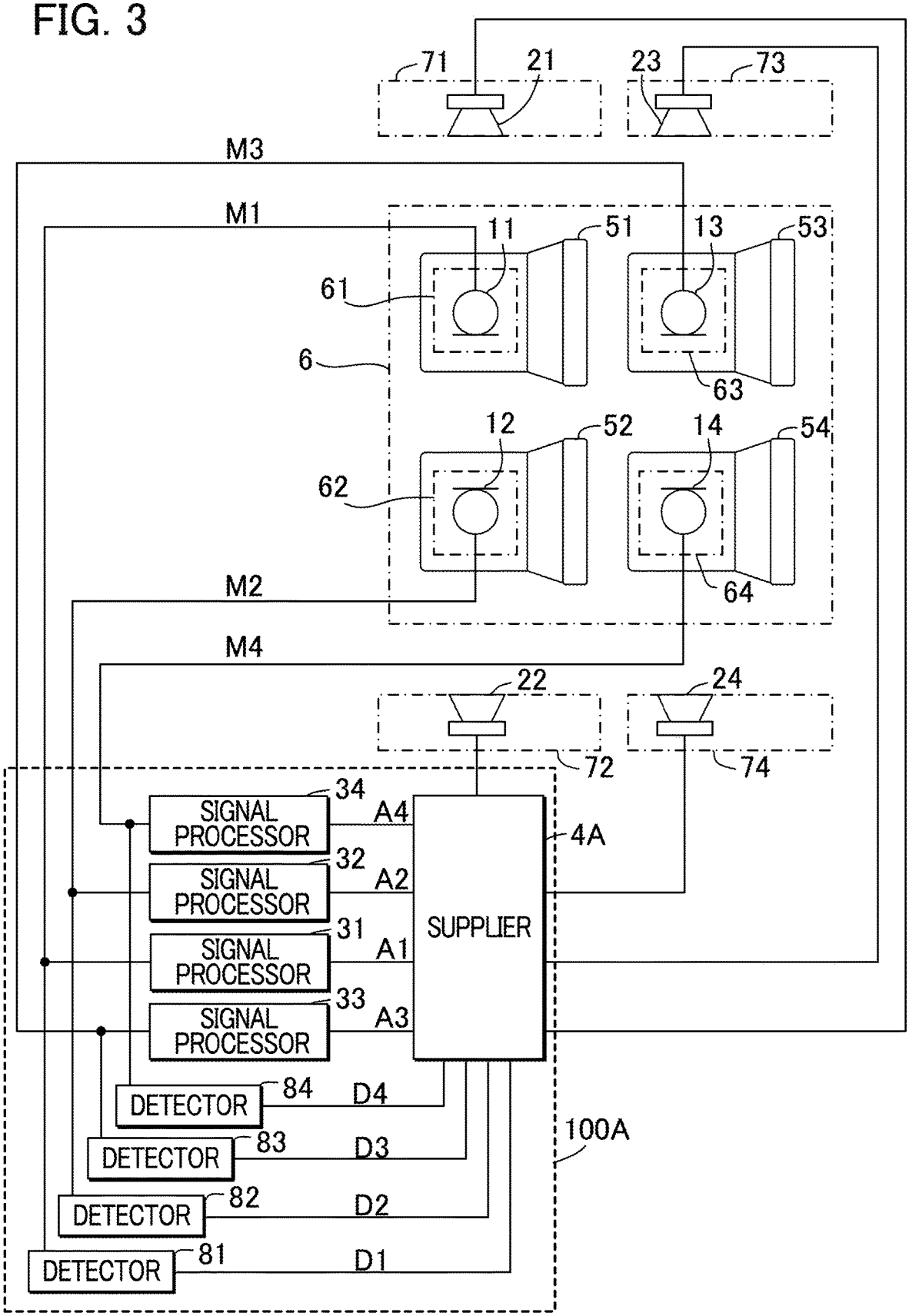
FIG. 3 is a diagram showing a conversation assist apparatus 100A according to a second embodiment.

FIG. 3 is a diagram showing a conversation assist apparatus 100A according to the second embodiment. In FIG. 3, the same reference symbols are used for identifying the same elements shown in FIG. 1. In the following, features of this embodiment that are different from the first embodiment will be focused on.

The conversation assist apparatus 100A is different from the conversation assist apparatus 100 shown in FIG. 1 in that the conversation assist apparatus 100A includes detectors 81 to 84, and includes a supplier 4A instead of the supplier 4. The supplier 4A is signal supply circuitry, for example.

The detector 81 detects occurrence of howling noise on the basis of the output signal M1 of the microphone 11. For example, the detector 81 compares each frequency component of the output signal M1 with a threshold having a predetermined level in different frequency bands, and decides that a howling noise has occurred in a case in which a frequency component of the output signal M1 in any frequency band exceeds the threshold. Upon detecting a howling noise, the detector 81 outputs a howling noise occurrence signal D1 indicating occurrence of howling noise. The detector 82 detects occurrence of howling noise on the basis of the output signal M2 of the microphone 12. The scheme for detecting howling noise of the detector 82 conforms to the scheme for detecting howling noise of the detector 81. Upon detecting a howling noise, the detector 82 outputs a howling noise occurrence signal D2. The detector 83 detects occurrence of howling noise on the basis of the output signal M3 of the microphone 13. The scheme for detecting howling noise of the detector 83 conforms to the scheme for detecting howling noise of the detector 81. Upon detecting a howling noise, the detector 83 outputs a howling noise occurrence signal D3. The detector 84 detects occurrence of howling noise on the basis of the output signal M4 of the microphone 14. The scheme for detecting howling noise of the detector 84 conforms to the scheme for detecting howling noise of the detector 81. Upon detecting a howling noise, the detector 84 outputs a howling noise occurrence signal D4.

Upon reception of any one of the howling noise occurrence signals D1 to D4, the supplier 4A changes the destinations of the audio signals A1 to A4.

Figure 4:
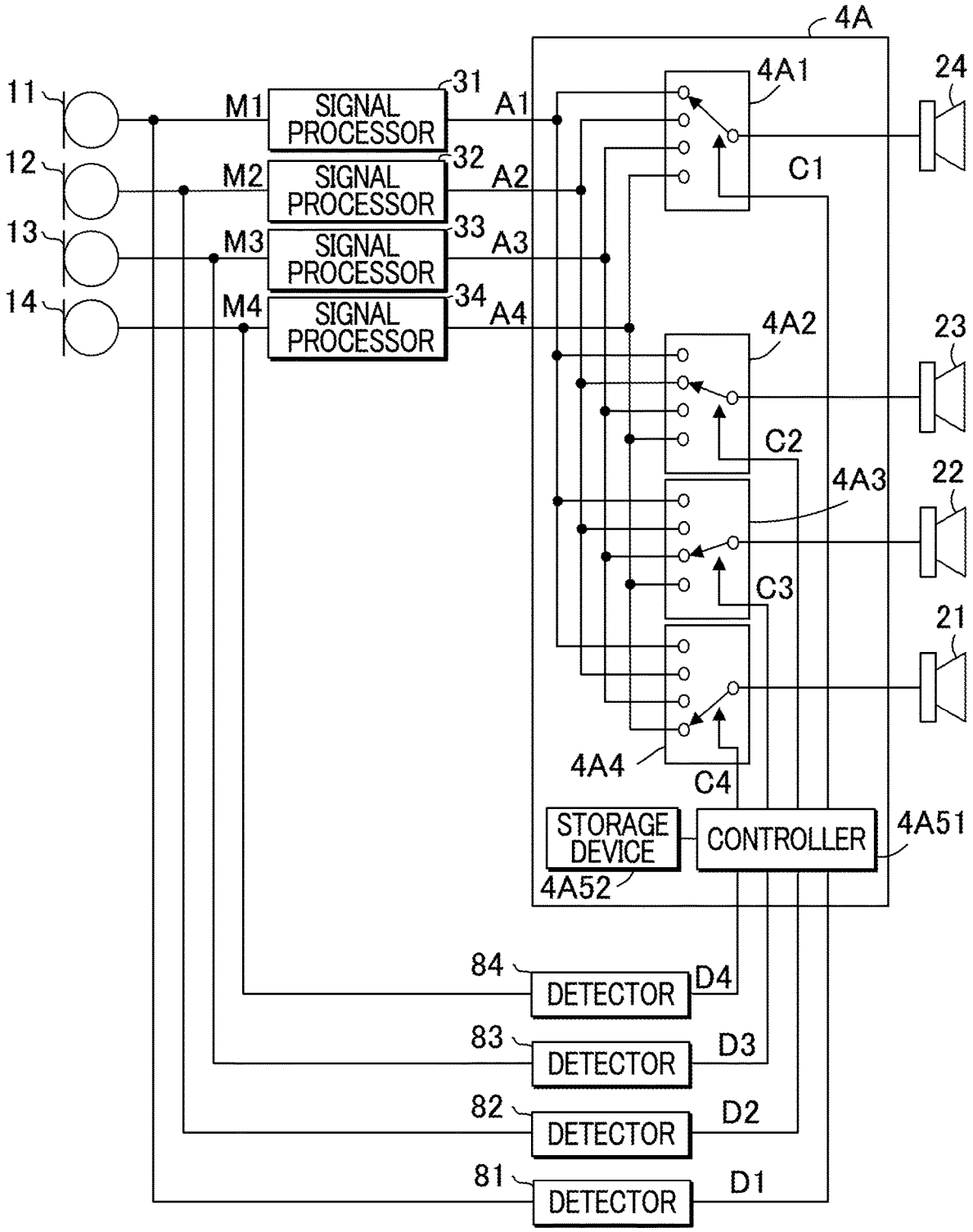
FIG. 4 is a diagram showing an example of the supplier 4A.

FIG. 4 is a diagram showing an example of the supplier 4A. The supplier 4A shown in FIG. 4 includes multiplexers 4A1 to 4A4, a controller 4A51, and a storage device 4A52. The multiplexer 4A1 supplies one of the audio signals A1 to A4 to the electric loudspeaker 24 on the basis of the control signal C1 from the controller 4A51. The multiplexer 4A2 supplies one of the audio signals A1 to A4 to the electric loudspeaker 23 on the basis of the control signal C2 from the controller 4A51. The multiplexer 4A3 supplies one of the audio signals A1 to A4 to the electric loudspeaker 22 on the basis of the control signal C3 from the controller 4A51. The multiplexer 4A4 supplies one of the audio signals A1 to A4 to the electric loudspeaker 21 on the basis of the control signal C4 from the controller 4A51.

By default, the multiplexer 4A1 supplies the audio signal A2 to the electric loudspeaker 24, the multiplexer 4A2 supplies the audio signal A1 to the electric loudspeaker 23, the multiplexer 4A3 supplies the audio signal A4 to the electric loudspeaker 22, and the multiplexer 4A4 supplies the audio signal A3 to the electric loudspeaker 21. Hereinafter, the state in which the multiplexers 4A1 to 4A4 are in the default state is referred to as a "default state".

The controller 4A51 is, for example, a CPU (Central Processing Unit). The controller 4A51 operates by reading and executing the program stored in the storage device 4A52. The storage device 4A52 is an example of a non-transitory computer-readable recording medium.

The storage device 4A52 is a recording medium of any known type, such as, a semiconductor recording medium, a magnetic recording medium, or an optical recording medium, or a combination thereof. In this specification, the "non-transitory" recording media is meant to include any type of computer-readable recording media, except for a recording medium for temporarily storing a transitory propagating signal, such as a transmission line, and does not exclude volatile recording media. The controller 4A51 controls the multiplexer 4A1 with the use of the control signal C1, controls the multiplexer 4A2 with the use of the control signal C2, controls the multiplexer 4A3 with the use of the control signal C3, and controls the multiplexer 4A4 with the use of the control signal C4.

Figure 5:
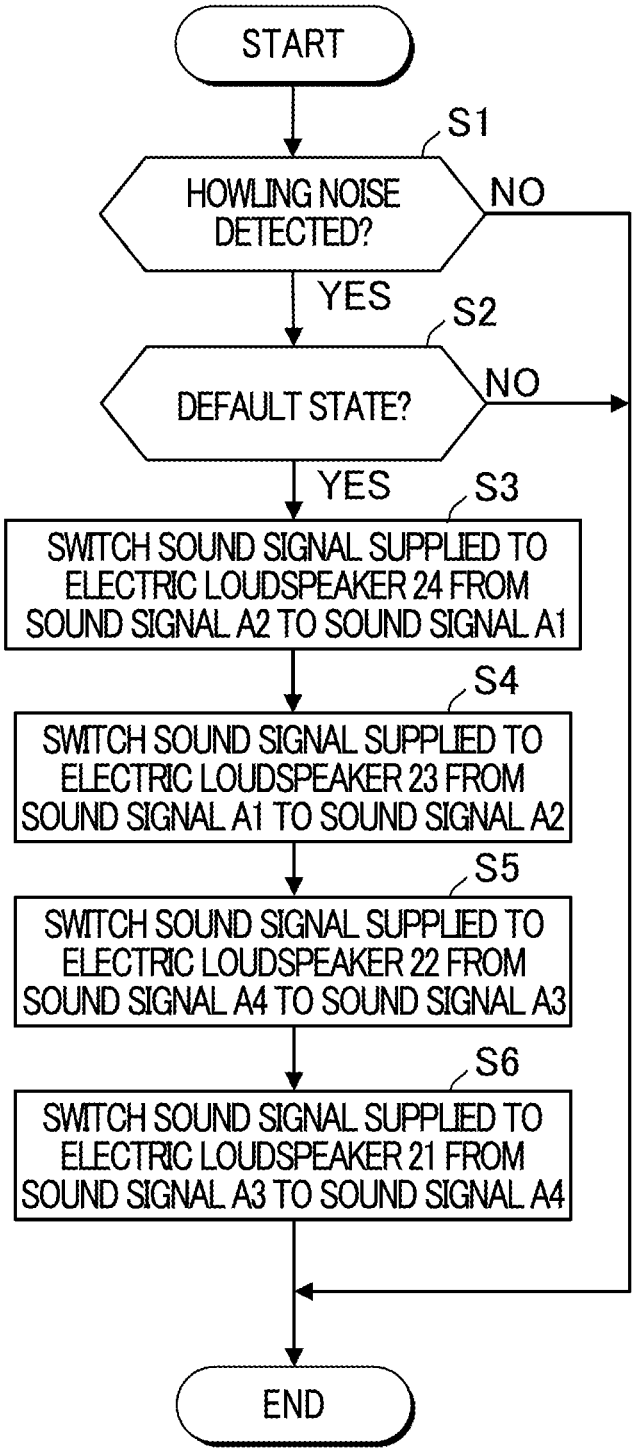
FIG. 5 is a flowchart for explaining an operation of a conversation assist apparatus 100A.

FIG. 5 is a flowchart for explaining an operation of conversation assist apparatus 100A. The supplier 4A repeatedly executes the operation shown in FIG. 5.

If any one of the detectors 81 to 84 detects howling noise (if the decision in step S1 is YES), the controller 4A51 receives one of howling noise occurrence signals D1 to D4. Upon receiving any one of the howling noise occurrence signal D1 to D4, the controller 4A51 decides whether or not the multiplexer 4A1 to 4A4 are in the default state (step S2).

If the multiplexer 4A1 to 4A4 are in the default state (if the decision in step S2 is YES), the controller 4A51 controls the multiplexer 4A1 by means of the control signal C1 to switch the audio signal supplied to the electric loudspeaker 24 from the audio signal A2 to the audio signal A1 (step S3).

Next, the controller 4A51 controls the multiplexer 4A2 by means of the control signal C2 to switch the audio signal supplied to the electric loudspeaker 23 from the audio signal A1 to the audio signal A2 (step S4).

Next, the controller 4A51 controls the multiplexer 4A3 by means of the control signal C3 to switch the audio signal supplied to the electric loudspeaker 22 from the audio signal A4 to the audio signal A3 (step S5).

Next, the controller 4A51 controls the multiplexer 4A4 by means of the control signal C4 to switch the audio signal supplied to the electric loudspeaker 21 from the audio signal A3 to the audio signal A4 (step S6). It is preferable that the controller 4A51 simultaneously execute steps S3 to S6. Hereinafter, the state of the multiplexers 4A1 to 4A4 when the step S6 is completed is referred to as a "special state".

Conditions of occurrence of howling noise may change depending on how the luggage is placed within the vehicle, for example, how the luggage is placed on the seats. Accordingly, in a case in which the multiplexers 4A1 to 4A4 are in the special state, if the controller 4A51 receives any one of the howling noise occurrence signals D1 to D4, the controller 4A51 may execute a first processing or a second processing described below.

First Processing

The controller 4A51 controls the multiplexer 4A1 using the control signal C1 to switch the audio signal supplied to the electric loudspeaker 24 from the audio signal A1 to the audio signal A3. The controller 4A51 controls the multiplexer 4A2 using the control signal C2 to switch the audio signal supplied to the electric loudspeaker 23 from the audio signal A2 to the audio signal A4. The controller 4A51 controls the multiplexer 4A3 using the control signal C3 to switch the audio signal supplied to the electric loudspeaker 22 from the audio signal A3 to the audio signal A1. The controller 4A51 controls the multiplexer 4A4 using the control signal C4 to switch the audio signal supplied to the electric loudspeaker 21 from the audio signal A4 to the audio signal A2. Hereinafter, the state of the multiplexers 4A1 to 4A4 when the first processing is completed is referred to as a "first state".

Second Processing

The controller 4A51 controls the multiplexer 4A1 using the control signal C1 to switch the audio signal supplied to the electric loudspeaker 24 from the audio signal A1 to the audio signal A4. The controller 4A51 controls the multiplexer 4A2 using the control signal C2 to switch the audio signal supplied to the electric loudspeaker 23 from the audio signal A2 to the audio signal A3. The controller 4A51 controls the multiplexer 4A3 using the control signal C3 to switch the audio signal supplied to the electric loudspeaker 22 from the audio signal A3 to the audio signal A2. The controller 4A51 controls the multiplexer 4A4 using the control signal C4 to switch the audio signal supplied to the electric loudspeaker 21 from the audio signal A4 to the audio signal A1. Hereinafter, the state of the multiplexers 4A1 to 4A4 when the second processing is completed is referred to as a "second state".

If the controller 4A51 receives any of the howling noise occurrence signals D1 to D4 when the multiplexers 4A1 to 4A4 are in the first state, the controller 4A51 may execute a third processing to change the state of the multiplexers 4A1 to 4A4 from the first state to the default state, the special state, or to the second state.

If the controller 4A51 receives any of the howling noise occurrence signals D1 to D4 when the multiplexers 4A1 to 4A4 are in the second state, the controller 4A51 may execute a fourth processing to change the state of the multiplexers 4A1 to 4A4 from the second state to the default state, the special state, or to the first state.

According to this embodiment, when howling noise occurs, it is possible to automatically cancel the howling noise. The default state can be changed freely unless the multiplexer is in the special state. In addition, if the controller 4A51 receives any of the howling noise occurrence signals D1 to D4 when the multiplexers 4A1 to 4A4 are in the default state, the controller 4A51 may execute a fifth processing to change the state of the multiplexers 4A1 to 4A4 from the default state to the first state or to the second state.

Third Embodiment

In the second embodiment, howling noise occurrence signals are automatically output. In contrast, in a third embodiment, howling noise occurrence signals are output depending on switch manipulation.

Figure 6:
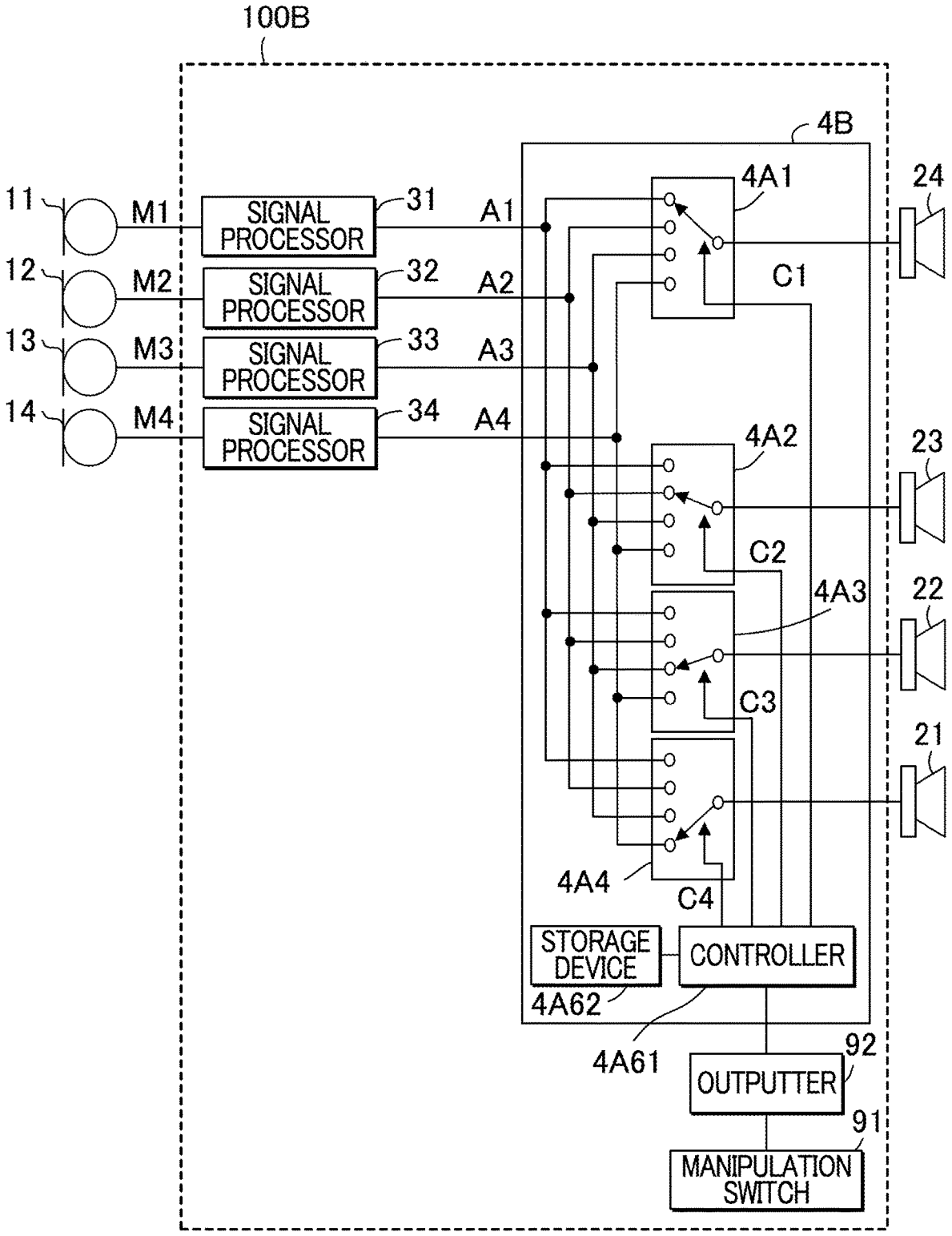
FIG. 6 is a diagram showing a conversation assist apparatus 100B according to a third embodiment.

FIG. 6 is a diagram showing a conversation assist apparatus 100B according to the third embodiment. In FIG. 6, the same reference symbols are used for identifying the same elements shown in FIG. 1. In the following, features of this embodiment that are different from the first embodiment will be focused on.

The conversation assist apparatus 100B is different from the conversation assist apparatus 100 shown in FIG. 1 in that the conversation assist apparatus 100B includes a manipulation switch 91 and an outputter 92 that outputs a howling noise occurrence signal D5 depending on the manipulation of the manipulation switch 91 by a user, and includes a supplier 4B instead of the supplier 4. The outputter 92 is output circuitry, for example. The supplier 4B is signal supply circuitry, for example. The supplier 4B includes multiplexers 4A1 to 4A4, a controller 4A61, and a storage device 4A62.

The controller 4A61 is, for example, a CPU. The controller 4A61 operates by reading and executing the program stored in the storage device 4A62. The storage device 4A62 is an example of a non-transitory computer-readable recording medium.

The storage device 4A62 is a recording medium of any known type, such as a semiconductor recording medium, a magnetic recording medium, or an optical recording medium, or a combination thereof. The controller 4A61 controls the multiplexer 4A1 with the use of the control signal C1, controls the multiplexer 4A2 with the use of the control signal C2, controls the multiplexer 4A3 with the use of the control signal C3, and controls the multiplexer 4A4 with the use of the control signal C4.

Figure 7:
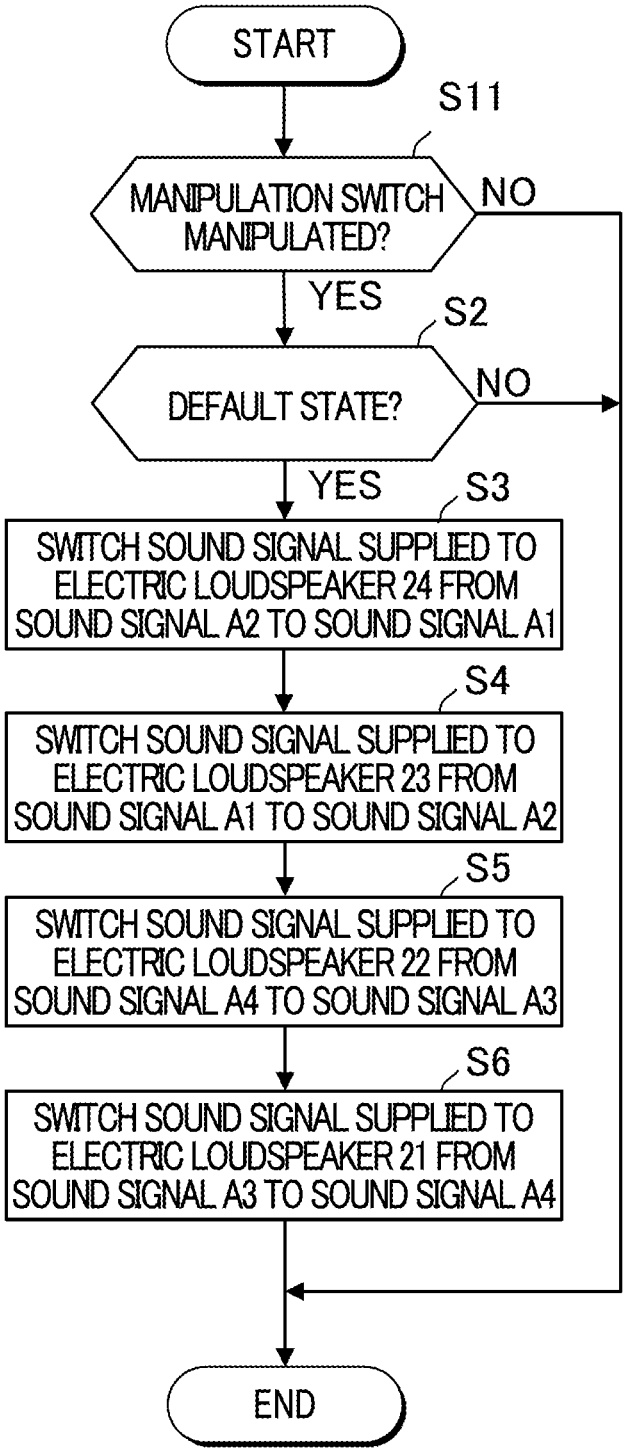
FIG. 7 is a flowchart for explaining an operation of a supplier 4B.

FIG. 7 is a flowchart for explaining an operation of the conversation assist apparatus 100B. In FIG. 7, the same reference symbols are used to identify the same steps shown in FIG. 5. In the following, steps shown in FIG. 7 that are different from the steps shown in FIG. 5 will be focused on. The supplier 4B repeatedly executes the operation shown in FIG. 7.

If the manipulation switch 91 is manipulated by a user (if the decision in step S11 is YES), the outputter 92 outputs a howling noise occurrence signal D5. Upon reception of the howling noise occurrence signal D5, the controller 4A61 executes step S2 and subsequent steps. It is desirable that the controller 4A61 simultaneously execute steps S3 to S6.

As described above, conditions of occurrence of howling noise may change depending on how luggage is placed within the vehicle, for example, how luggage is placed on the seats. Accordingly, in a case in which the multiplexers 4A1 to 4A4 are in the special state, if the controller 4A61 receives the howling noise occurrence signal D5, the controller 4A61 may execute the aforementioned first processing or the aforementioned second processing. In this case, the subject of the process is the controller 4A61, rather than the controller 4A51.

The controller 4A61 may execute the third processing if the controller 4A61 receives the howling noise occurrence signal D5 in a case in which the multiplexers 4A1 to 4A4 are in the first state.

The controller 4A61 may execute the fourth processing if the controller 4A61 receives the howling noise occurrence signal D5 in a case in which the multiplexers 4A1 to 4A4 are in the second state. The controller 4A61 may execute the fifth processing if the controller 4A61 receives any one of the howling noise occurrence signals D1 to D4 in a case in which the multiplexers 4A1 to 4A4 are in the default state.

According to this embodiment, when howling noise occurs, it is possible to cancel the howling noise depending on the manipulation of the manipulation switch by the user.

Variations

The above-exemplified embodiments may be variously modified.

Specific variations will be exemplified below. Two or more variations freely selected from the following variations may be appropriately combined unless they conflict.

Variation A1

The signal processor 31 may execute only the process of amplifying the output signal M1 without executing signal processing for adding a delay to the output signal M1. The signal processors 32 to 34 may also execute signal processing in a similar manner as that of the signal processor 31.

Variation A2

In the above-described embodiments, the signal processor 31 adds a delay to the output signal M1, and amplifies the delayed output signal M1. However, the process of adding a delay to the output signal M1 may be executed somewhere between the input terminal of the signal processor 31 and the output terminal of the supplier 4, 4A, or 4B. In addition, the process of adding a delay to the output signal M2 may be executed somewhere between the input terminal of the signal processor 32 and the output terminal of the supplier 4, 4A or 4B. The process of adding a delay to the output signal M3 may also be executed somewhere between the input terminal of the signal processor 33 and the output terminal of the supplier 4, 4A or 4B. The process of adding a delay to the output signal M4 may also be executed somewhere between the input terminal of the signal processor 34 and the output terminal of the supplier 4, 4A or 4B. The process of adding a delay includes, for example, storing a digital signal corresponding to the output signal of the microphone in an internal memory in each of the signal processors 31 to 34, and reading the digital signal from the memory to output the digital signal when a delay time has elapsed after the time point of storing. In this case, memories having a capacity corresponding to the digital signal corresponding to the output signal of the microphone may be used.

Variation A3

One or more seats may be located between the seats 51 and 53. One or more seats may also be located between the seats 52 and 54. Furthermore, the seats 53 and 54 may be formed unitarily. One or more seats may also be located between the seats 53 and the seat 54. In this case, the seat between the seats 53 and seat 54, the seat 53, and the seat 54 may be formed unitarily.

Variation A4

The order of executing steps S3 to S6 shown in FIGS. 5 and 7 may be changed freely.

Fourth Embodiment

If the delay time added to the output signal of the microphone is constant, there may be likelihood that the sound from the electric loudspeakers is difficult to hear depending on the volume of noise. For example, Japanese Patent Application Laid-Open Publication No. 2008-42390 discloses an in-vehicle conversation support system that receives sound uttered by a human speaker with a microphone, delays the sound for a predetermined time (5 to 20 ms), and outputs the delayed sound from an electric loudspeaker. However, if the delay time added to the output signal of the microphone is constant, it may be likely that the sound from the electric loudspeakers is difficult to hear depending on the volume of noise. For example, if a loud noise continues for a period in which sound is uttered by a human speaker and within which sound (sound corresponding to the sound of the human speaker) is output from electric loudspeaker, the listener may not be able to hear both the sound uttered by the human speaker and the sound from the electric loudspeaker. If the delay time is lengthened in order to deal with this problem in a situation in which the volume of noise decreases depending on the state of the vehicle, the listener will receive the sound from the electric loudspeaker at a timing that is considerably later than the sound uttered by the human speaker. Accordingly, the listener might have difficulty in hearing the sound from the electric loudspeaker due to the uncomfortable sound from the electric loudspeaker. In addition, since the human speaker receives the speaker's own sound from the electric loudspeaker at a timing that is considerably later than the timing of voice utterance, the human speaker might feel uncomfortable with the sound from the electric loudspeaker. Accordingly, the human speaker might have difficulty in hearing the sound from the electric loudspeaker due to the uncomfortable sound from the electric loudspeaker. Accordingly, in a fourth embodiment, the delay time that is to be added to the output signals of the microphones is controlled.

Figure 8:
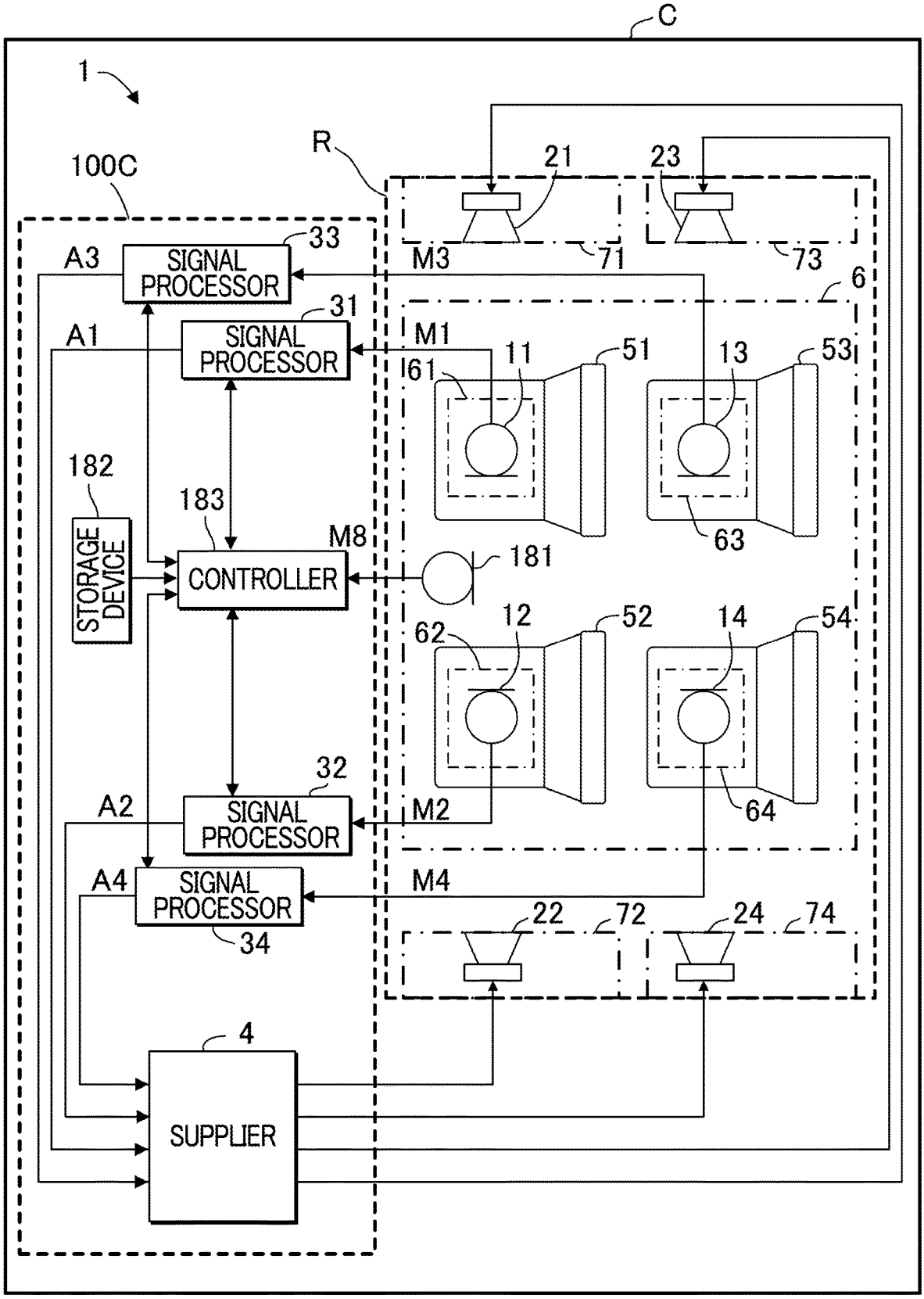
FIG. 8 is a diagram showing a conversation assist apparatus 100C according to a fourth embodiment.

FIG. 8 is a diagram showing a conversation assist system 1 including a conversation assist apparatus 100C according to the fourth embodiment. The conversation assist system 1 is used in a vehicle C. In the passenger compartment R of the vehicle C, seats 51 to 54, a ceiling 6, a front right door 71, a front left door 72, a rear right door 73, and a rear left door 74 are located in addition to the conversation assist apparatus 100C.

The conversation assist system 1 includes microphones 11 to 14 and 181, electric loudspeakers 21 to 24, and a conversation assist apparatus 100C. The microphone 181 receives sounds in the passenger compartment R, and outputs an output signal M8 corresponding to the received sound. The output signal M8 is used to identify the noise level in the passenger compartment R. Noise is meant to include the engine sound, the tire noise, the wind noise, the sound of the air conditioner in the passenger compartment, the environmental sound from the outside of the vehicle, and the like while the vehicle is traveling.

Figure 9:
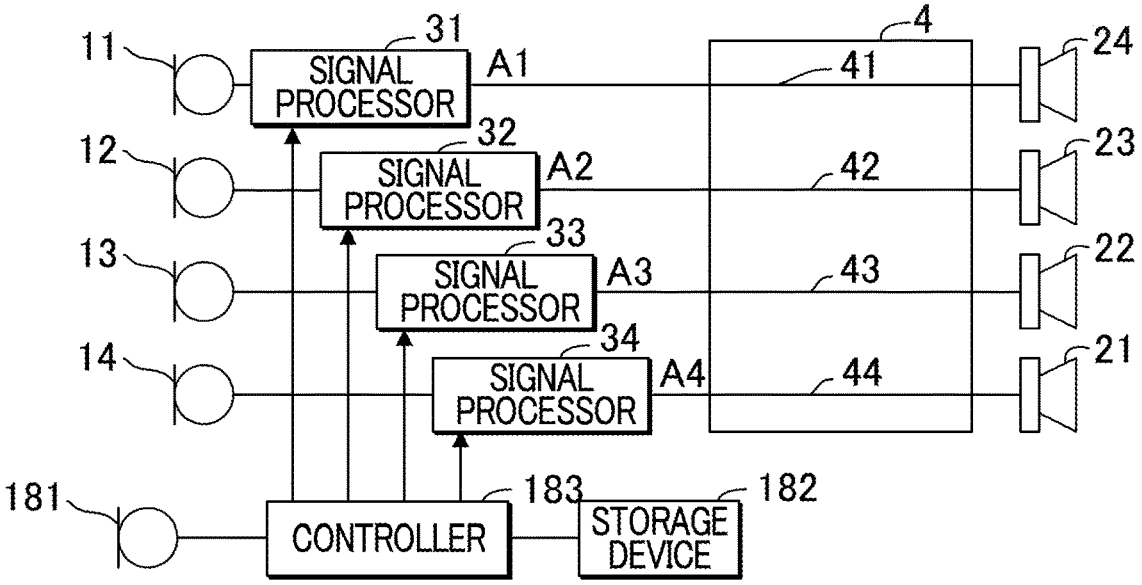
FIG. 9 is a diagram showing an example of a supplier 4.

The conversation assist apparatus 100C includes signal processors 31 to 34, a supplier 4, a storage device 182, and a controller 183. The supplier 4 is signal supply circuitry, for example. Each of the signal processors 31 to 34 is an example of a sound processor. The signal processor 31 generates an audio signal A1 by adding a delay to the output signal M1 of the microphone 11 as described above. In the present embodiment, the process of adding a delay includes, for example, storing a digital signal corresponding to the output signal M1 in an internal memory in the signal processor 31, and reading the digital signal from the memory in order to output the digital signal when a delay time has elapsed after the time point at which the digital signal is stored. In this case, a memory having a capacity equal to or greater than the data amount of the digital signal corresponding to the output signal M1 may be used. The process of adding a delay to the output signal in the signal processors 32 to 34 is similar to the process in which the signal processor 31 adds a delay to the output signal. The delay time added to the output signals M1 to M4 is controlled according to the state of the vehicle C (for example, the noise level in the passenger compartment R). FIG. 9 is a diagram showing an example of the supplier 4.

Figure 10:
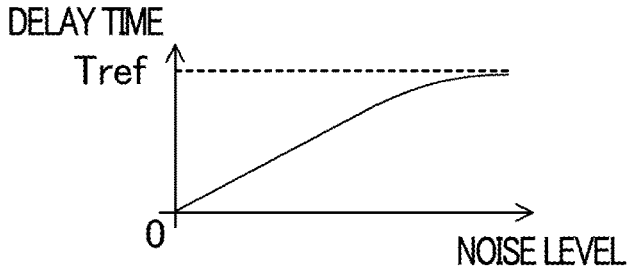
FIG. 10 is a diagram showing an example of noise relationship information.

The storage device 182 may be any known type of a recording medium, such as a semiconductor recording medium, a magnetic recording medium, or an optical recording medium, or a combination thereof. The storage device 182 stores a program that defines operations of the controller 183 and noise relationship information indicating a correspondence relationship between the noise level and the delay time. The noise relationship information may be a table in which the noise level and the delay time are associated with each other, or may be a formula in which the noise level is an independent variable and the delay time is a dependent variable. FIG. 10 is a diagram showing an example of the correspondence relationship between the noise level and the delay time indicated by the noise relationship information. In accordance with the noise relationship information shown in FIG. 10, the higher the noise level is, the longer the delay time is. An upper limit value Tref (for example, 50 ms) is defined for the delay time. If the delay time is too long and the sound from the electric loudspeaker coincides with the next mora of the human speaker's live voice, it will be impossible to distinguish between the preceding and succeeding moras, making hearing difficult. In view of this, the upper limit value Tref is set to have a time shorter than the delay time that causes difficulty in speech recognition. The upper limit value Tref is not limited to 50 ms, and may be freely changed.

The controller 183 is a computer, such as a CPU. The controller 183 operates as follows by reading and executing the program stored in the storage device 182. The controller 183 controls the delay time, which is to be added to the output signals M1 to M4, depending on the state of the vehicle C (for example, the noise level in the passenger compartment R). For example, the controller 183 identifies the noise level in the passenger compartment R using the output signal M8 of the microphone 181. The noise level in the passenger compartment R is the volume of sounds other than conversation in the passenger compartment R (for example, the traveling sound of the vehicle C and environmental sound). The controller 183 decides the delay time corresponding to the noise level in the passenger compartment R using the noise relationship information stored in the storage device 182. The controller 183 sets the delay time to be added by the signal processors 31 to 34 to have the delay time decided by using the noise relationship information.

Figure 11:
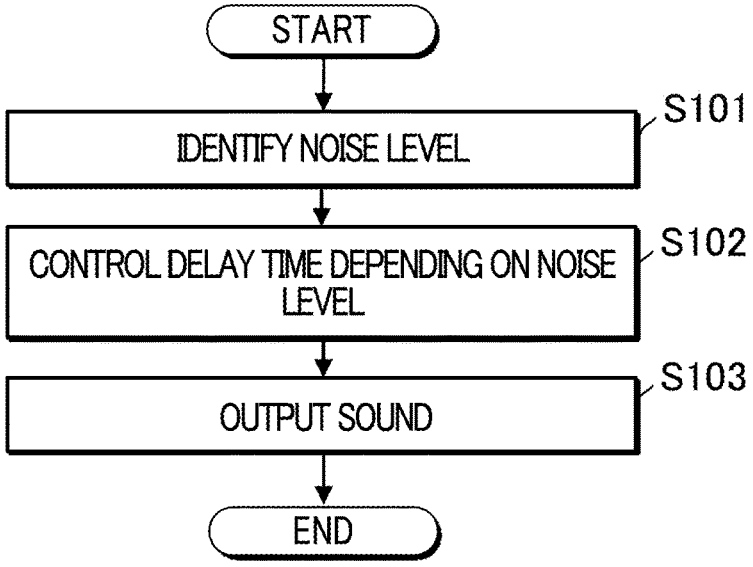
FIG. 11 is a flowchart for explaining an operation of the conversation assist apparatus 100C.

Next, the operation will be described. FIG. 11 is a flowchart for explaining an operation of the conversation assist apparatus 100C. The controller 183 first identifies the noise level in the passenger compartment R (step S101). In step S101, the controller 183 extracts an audio signal indicating the noise in the passenger compartment R by subtracting the output signals M1 to M4 from the output signal M8. The controller 183 identifies the noise level on the basis of the audio signal. The controller 183 receives the output signal M1 from, for example, the signal processor 31. The controller 183 receives the output signal M2 from the signal processor 32. The controller 183 receives the output signal M3 from the sound processor 33. The controller 183 receives the output signal M4 from the signal processor 34.

Next, the controller 183 controls the delay time, which is to be added to the output signals M1 to M4, depending on the noise level in the passenger compartment R (step S102). In step S102, the controller 183 decides the delay time corresponding to the noise level in the passenger compartment R, using the noise relationship information stored in the storage device 182. In accordance with the noise relationship information, the delay time increases as the noise level increases. Therefore, the controller 183 lengthens the delay time as the noise level in the passenger compartment R increases. Then, the controller 183 supplies delay time information indicating the decided delay time to the signal processors 31 to 34. The signal processor 31 adds the delay time indicated in the delay time information to the output signal M1 to generate an audio signal A1. The signal processor 32 adds the delay time to the output signal M2 to generate an audio signal A2. The signal processor 33 adds the delay time to the output signal M3 to generate an audio signal A3. The signal processor 34 adds the delay time to the output signal M4 to generate an audio signal A4.

Next, the supplier 4 supplies the audio signal A1 to the electric loudspeaker 24, supplies the audio signal A2 to the electric loudspeaker 23, supplies the audio signal A3 to the electric loudspeaker 22, and supplies the audio signal A4 to the electric loudspeaker 21. The electric loudspeaker 24 outputs a sound corresponding to the audio signal A1. The electric loudspeaker 23 outputs a sound corresponding to the audio signal A2. The electric loudspeaker 22 outputs a sound corresponding to the audio signal A3. The electric loudspeaker 21 outputs a sound corresponding to the audio signal A4 (step S103).

According to this embodiment, depending on the noise level in the passenger compartment R, the delay time of the output signals of the microphones is controlled. For this reason, the delay time can be controlled according to the noise level in the passenger compartment R, so that the listener can easily hear the speech of the human speaker, and so that the listener or the human speaker is unlikely to feel uncomfortable with the sound from the electric loudspeakers. For example, if the delay time is increased as the noise level in the passenger compartment R increases, both the sound uttered by the human speaker and the sounds output by the electric loudspeakers are unlikely to coincide with a sudden and loud noise. Therefore, the listener can easily hear the human speaker's speech. The lower the noise level in the passenger compartment R is, the shorter the time difference between the sound uttered by the human speaker and the sound from the electric loudspeaker is. Therefore, the listener or the human speaker is unlikely to feel uncomfortable about the sound from the electric loudspeakers.

Fifth Embodiment

The noise level in the passenger compartment R is considered to have a strong correlation with the speed of the vehicle C. For example, as the speed of vehicle C increases, the noise level in the passenger compartment R tends to increase. Accordingly, in a fifth embodiment, the delay time of the output signals of the microphones is controlled depending on the speed of vehicle C.

Figure 12:
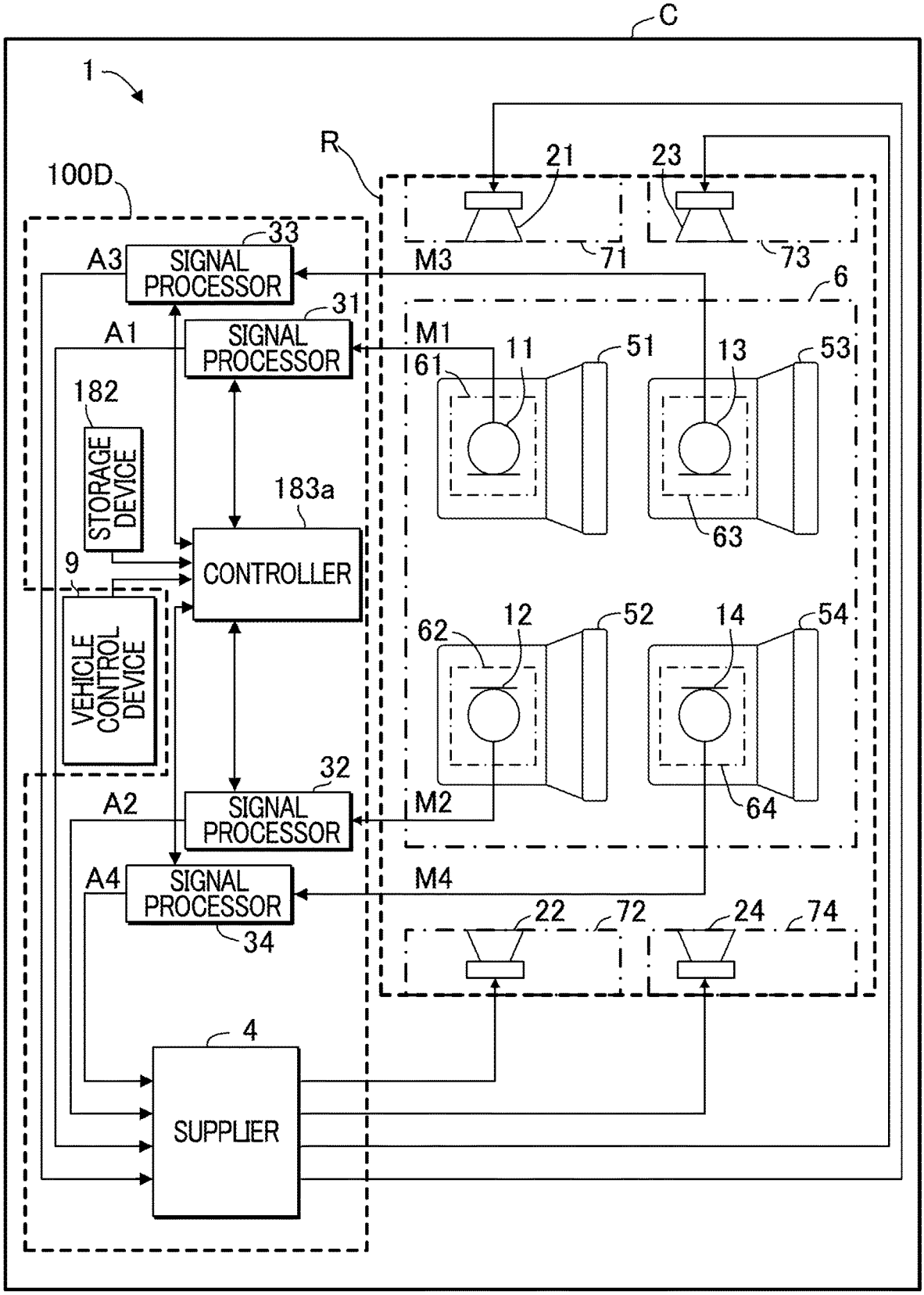
FIG. 12 is a diagram showing a conversation assist apparatus 100D according to a fifth embodiment.

FIG. 12 is a diagram showing a conversation assist apparatus 100D of the fifth embodiment. The conversation assisting apparatus 100D is different from the conversation assist apparatus 100C of the fourth embodiment in that the storage device 182 stores speed relationship information indicating a correspondence relationship between the speed and the delay time, instead of the noise relationship information, the conversation assist apparatus 100D has a controller 183*a* instead of the controller 183, and the controller 183*a* receives speed information indicating the speed of the vehicle C from a vehicle control device 9. In addition, the microphone 181 in the passenger compartment R in the fourth embodiment is omitted in the fifth embodiment. In the following, the different features of the conversation advice apparatus 100D will be focused on.

Figure 13:
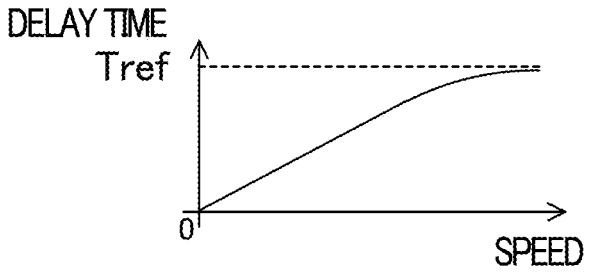
FIG. 13 is a diagram showing an example of speed relationship information.

The vehicle control device 9 controls the state of the vehicle C (for example, the speed of the vehicle C). The vehicle control device 9 supplies speed information to the controller 183*a*. The storage device 182 stores speed relationship information as shown in FIG. 13. The speed relationship information may be a table in which the speed and the delay time are associated with each other, or may be a formula in which the speed is an independent variable and the delay time is a dependent variable. In accordance with the speed relationship information shown in FIG. 13, the faster the speed is, the longer the delay time is. An upper limit value Tref (for example, 50 ms) is defined for the delay time as described above. The controller 183*a* controls the delay time, which is to be added to the output signals M1 to M4, to vary depending on the speed of the vehicle C. Specifically, the controller 183*a* decides the delay time corresponding to the speed indicated by the speed information using the speed relationship information in the storage device 182. In accordance with the speed relationship information in the storage device 182, the faster the speed is, the longer the delay time is. Therefore, the controller 183*a* lengthens the delay time as the vehicle C speed increases. Then, the controller 183*a* supplies delay time information indicating the decided delay time to the signal processors 31 to 34.

According to this embodiment, the delay time of the output signals of the microphones is controlled depending on the speed of the vehicle C, where the speed has a strong correlation with the noise level in the passenger compartment R. For this reason, the delay time can be controlled depending on the speed of the vehicle C, so that the listener can easily hear the speech of the human speaker, and so that the listener or the human speaker is unlikely to feel uncomfortable with the sound from the electric loudspeakers. For example, if the delay time is lengthened as the speed of the vehicle C is increased (as the noise level in the passenger compartment R is increased), both the sound uttered by the human speaker and the sounds output from the electric loudspeakers are unlikely to coincide with a sudden and loud noise. Therefore, the listener can easily hear the human speaker's speech. The slower the speed of the vehicle C is (the lower the noise level in the passenger compartment R is), the shorter the time difference between the sound uttered by the human speaker and the sound from the electric loudspeaker is. Therefore, the listener or the human speaker is unlikely to feel uncomfortable about the sound from the electric loudspeakers.

Variations

The above-exemplified fourth and fifth embodiments may be variously modified. Specific variations will be exemplified below. Two or more variations freely selected from the following variations may be appropriately combined unless they conflict.

Variation B1

An amplifier that amplifies the audio signal A1, an amplifier that amplifies the audio signal A2, an amplifier that amplifies the audio signal A3, and an amplifier that amplifies the audio signal A4 may be added. However, without adding these amplifiers, the signal processor 31 may amplify the audio signal A1, the signal processor 32 may amplify the audio signal A2, the signal processor 33 may amplify the audio signal A3, and the signal processor 34 may amplify the audio signal A4.

Variation B2

Figure 14:
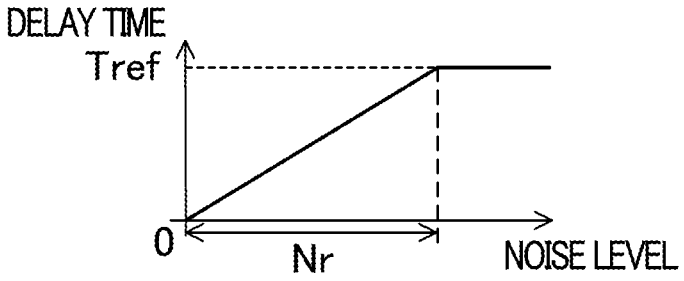
FIG. 14 is a diagram showing another example of noise relationship information.
Figure 15:
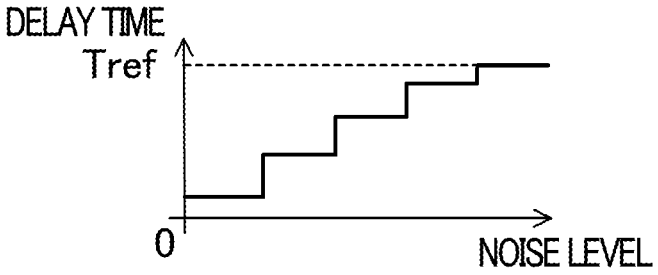
FIG. 15 is a diagram showing a further example of noise relationship information.
Figure 16:
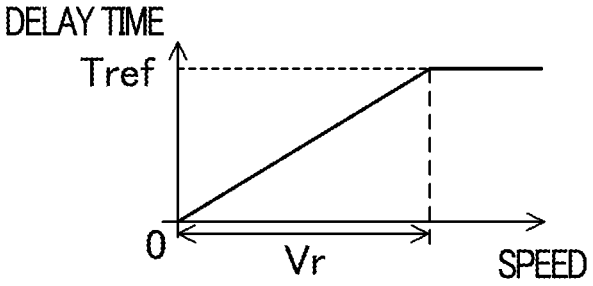
FIG. 16 is a diagram showing another example of noise relationship information.
Figure 17:
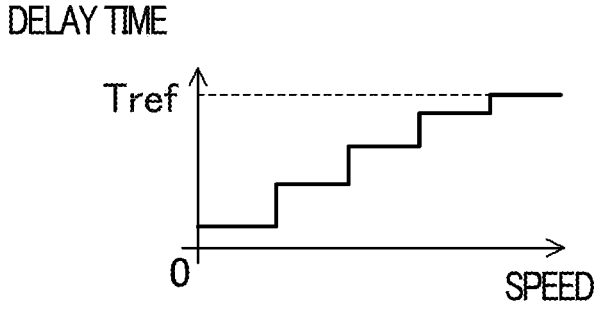
FIG. 17 is a diagram showing a further example of noise relationship information.

The noise relationship information may be changed in a freely selected manner. For example, another type of noise relationship information, such as shown in FIG. 14 or 15, which represents the relationship between the noise level and the delay time, may be used. According to the noise relationship information shown in FIG. 14, if the noise level falls within a predetermined range Nr, the delay time becomes longer as the noise level is greater. According to the noise relationship information shown in FIG. 15, the delay time increases step by step as the noise level increases. In addition, the speed relationship information may also be changed in a freely selected manner. For example, another type of speed relationship information, such as shown in FIG. 16 or 17, representing the relationship between the speed and delay time may be used. According to the speed relationship information shown in FIG. 16, if the speed falls within a predetermined range Vr, the delay time becomes longer as the speed is greater. According to the speed relation information shown in FIG. 17, the delay time increases step by step as the speed increases. Here, the predetermined ranges Nr and Vr may be defined for each of vehicles C. In this case, it is possible to define the noise relationship information and the speed relationship information according to the sound transmission characteristic in each vehicle C. In addition, in a case in which the delay time changes stepwise depending on the noise level or speed as shown in FIGS. 15 and 17, it is possible to reduce the frequency of changing the delay time compared to a case in which the delay time changes linearly depending on the noise level or speed, thus realizing simplified processing.

Variation B3

The supplier 4 may change the destinations (electric loudspeakers) of the audio signals A1 to A4 in a freely selected manner. For example, the supplier 4 may supply multiple audio signals to a single electric loudspeaker.

Variation B4

One or more seats may be located between the seats 51 and 53. One or more seats may also be located between the seats 52 and 54. Furthermore, the seats 53 and 54 may be formed unitarily. One or more seats may also be located between the seats 53 and the seat 54. In this case, the seat between the seats 53 and seat 54, the seat 53, and the seat 54 may be formed unitarily.

Variation B5

The controller 183 and/or the controller 183*a* may receive the output signal M1 from the microphone 11, may receive the output signal M2 from the microphone 12, may receive the output signal M3 from the microphone 13, may receive the output signal M4 from the microphone 14, and not via the signal processors 31 to 34.

Variation B6

The controller 183 and/or the controller 183*a* may change the delay time for each of the electric loudspeakers.

Variation B7

A manipulation device (for example, a manipulation switch) for activating and deactivating the control of the delay time may be provided. In this case, when the user has manipulated the manipulation device to activate the control of the delay time, the controllers 183 and 183*a* may control the delay time.

Variation B8

In the fourth embodiment, the noise level in the passenger compartment R is identified by subtracting the output signals M1 to M4 from the output signal M8. Instead, signals with frequencies corresponding to noise may be extracted by filtering the output signal M8, and the noise level in the passenger compartment R may be identified based on the signals having the frequencies.

Variation B9

The noise level in the passenger compartment R is considered to have a strong correlation with the rotational speed of the engine in the vehicle C and the rotational speed of the blower in the air conditioner in the vehicle C. For example, as the rotational speed of the engine in the vehicle C or the rotational speed of the fan of the air conditioner in the vehicle C increases, the noise level in the passenger compartment R tends to increase. Accordingly, in the fifth embodiment, the rotational speed of the engine in the vehicle C or the rotational speed of the blower in the air conditioner in the vehicle C may be used as the state of the vehicle C instead of the speed of the vehicle C. In this case, the controller 183*a* receives information about the engine speed of the vehicle C or information about the rotational speed of the blower in the air conditioner in the vehicle C from the vehicle control device 9, and controls the delay time such that the greater the rotational speed of the engine in the vehicle C or the blower in the air conditioner in the vehicle C is, the longer the delay time is. In this case, the controller 183*a* may decide the delay time with the use of engine-rotational-speed relationship information or blower-rotational-speed relationship information. The engine-rotational-speed relationship information indicates that the higher the rotational speed of the engine in the vehicle C is, the longer the delay time is. The blower-rotational-speed relationship information indicates that the higher the rotational speed of the blower in the air conditioner in the vehicle C is, the longer the delay time is.

From the above-described embodiments and variations, the following aspects are derivable. An aspect (first aspect) of a conversation assist apparatus includes a supplier that supplies an audio signal generated based on an output signal of one of microphones that is arranged so as to correspond to respective four seats arranged in a rectangular manner, to one of electric loudspeakers that corresponds to a diagonal seat, from among the four seats, that is located at a diagonal position of a seat corresponding to the one of the microphones. According to this aspect, it is possible to supply an audio signal to an electric loudspeaker, from among the electric loudspeakers that are arranged so as to correspond to the respective four seats which is the most distant from the one of the microphones outputting the output signal that is the origin of the audio signal. Therefore, it is possible to reduce the occurrence of howling noise during conversation, thus making it easier to hear the sound output from the electric loudspeaker. Furthermore, according to this aspect, since a seat is interposed between the microphone that outputs the output signal and the electric loudspeaker to which the audio signal is supplied, the sound output from the electric loudspeaker is likely to be absorbed by the seat. As a result, it is possible to reduce the probability of occurrence of howling noise.

Another aspect (second aspect) according to the first aspect may include a signal processor that generates the audio signal by adding a delay to the output signal of the one of the microphones. It is known that a human voice is difficult to understand in a case in which the time interval between syllables is longer. Accordingly, if a reverberation is imparted to the voice uttered by a human speaker, the time interval between syllables will be small, and the sound uttered by the human speaker will be easy for the listener to hear. However, since the seats have a sound absorbing property, reverberation of the voice uttered by the human speaker is smaller than reverberation of the voice in a case in which there are no seats. Accordingly, compared to the case in which the seats do not exist, the time interval between syllables of the voice spoken by the human speaker may be greater. Therefore, it might become difficult for the listener to hear the voice. According to this aspect, at least a delay is added to the output signal of the one of the microphones to generate an audio signal. The sound output from the one of the electric loudspeakers in response to the audio signal serves as a reverberation of the voice uttered by the human speaker. Therefore, compared with the case in which no delay is added to the output signal of the microphone, the time interval between syllables can be made small, thereby reducing the probability that the sound will difficult for the listener to hear.

In another aspect (third aspect) according to the second aspect, the microphones, the electric loudspeakers, and the seats may be located in a passenger compartment, and the conversation assist apparatus may further include a controller that controls the time of the delay depending on a state of a vehicle including the passenger compartment. According to this aspect, depending on the state of the vehicle, the delay time is controlled such that the listener can easily hear the speech of the human speaker. For this reason, in comparison with a case in which the delay time is constant regardless of the state of the vehicle, the listener can easily hear the speech of the human speaker. For example, if the delay time is lengthened in a situation in which the noise level is increased depending on the state of the vehicle, both the sound uttered by the human speaker and the sound output from the electric loudspeaker are unlikely to coincide with a sudden and loud noise. Therefore, the listener can easily hear the human speaker's speech. If the delay time is shortened in a situation in which the noise level is decreased depending on the state of the vehicle, the shorter the time difference between the sound uttered by the human speaker and the sound from the electric loudspeaker is. Therefore, the listener or the human speaker is unlikely to feel uncomfortable about the sound from the electric loudspeaker.

Another aspect (fourth aspect) of a conversation assist apparatus includes: a supplier that switches, upon reception of a howling noise occurrence signal indicative of occurrence of a howling noise, a destination of an audio signal that is generated based on an output signal of one of the microphones that are arranged so as to correspond to respective four seats arranged in a rectangular manner, from an electric loudspeaker that is a current destination of the audio signal, from among electric loudspeakers arranged so as to correspond to the respective four seats, to another one of the electric loudspeakers that is different from the electric loudspeaker that is the current destination of the audio signal. According to this aspect, for example, when howling noise occurs, it is possible to cancel the howling noise.

Another aspect (fifth aspect) according to the fourth aspect may further include a detector that outputs the howling noise occurrence signal upon detecting the howling noise. In this aspect, the supplier may receive the howling noise occurrence signal from the detector. According to this aspect, when howling noise occurs, it is possible to automatically cancel the howling noise.

Another aspect (sixth) according to the fourth aspect may further include: a manipulation switch; and an outputter that outputs the howling noise occurrence signal in response to a manipulation of the manipulation switch. In this aspect, the supplier may receive the howling noise occurrence signal from the outputter. According to this aspect, when howling noise occurs, it is possible to cancel the howling noise depending on the manipulation of the manipulation switch by the user.

An aspect (seventh aspect) of a conversation assist method includes: upon reception of a howling noise occurrence signal indicative of occurrence of a howling noise, switching a destination of an audio signal that is generated based on an output signal of one of microphones that are arranged so as to correspond to respective four seats arranged in a rectangular manner, from an electric loudspeaker that is a current destination of the audio signal, from among electric loudspeakers arranged so as to correspond to the respective four seats, to another one of the electric loudspeakers, from among the electric loudspeakers, that is different from the electric loudspeaker that is the current destination of the audio signal.

In another aspect (eighth aspect) according to the third aspect, the state of the vehicle may be the noise level in the passenger compartment.

In another aspect (ninth aspect) according to the third aspect, the state of the vehicle may be the speed of the vehicle.

In another aspect (tenth aspect) according to the third aspect, the state of the vehicle may be the rotational speed of the engine.

In another aspect (eleventh aspect) according to the third aspect, the state of the vehicle may be the rotational speed of a fan of an air conditioner in the vehicle.

In another aspect (twelfth aspect) according to the first aspect, upon receiving a howling noise occurrence signal indicative of occurrence of a howling noise in a situation in which the supplier supplies the audio signal to an electric loudspeaker, from among the electric loudspeakers, that is arranged so as to correspond to a seat that is different from the diagonal seat, the supplier may switch the destination of the audio signal from the electric loudspeaker arranged so as to correspond to the seat different from the diagonal seat to the electric loudspeaker arranged so as to correspond to the diagonal seat. According to this aspect, for example when howling noise occurs, it is possible to cancel the howling noise.

In another aspect (thirteenth aspect) according to the first aspect, upon reception of a howling noise occurrence signal indicative of occurrence of a howling noise in a situation in which the supplier supplies the audio signal to the electric loudspeaker arranged so as to correspond to the diagonal seat, the supplier may switch the destination of the audio signal from the electric loudspeaker arranged so as to correspond to the diagonal seat to an electric loudspeaker, from among the electric loudspeakers, arranged so as to correspond to a seat that is different from the diagonal seat. Conditions of occurrence of howling noise may change depending on, for example, how luggage is placed on the seats. According to this aspect, when howling noise occurs due to, for example, change in howling noise occurrence conditions, in a case in which the destination of the audio signal is the electric loudspeaker arranged so as to correspond to the diagonal seat, it is possible to cancel the howling noise since the destination of the audio signal is switched.

An aspect (fourteenth aspect) of a conversation assist apparatus includes a sound processor that causes an electric loudspeaker in a passenger compartment to output a sound received by a microphone in the passenger compartment with a delay, and a controller that controls the time of the delay depending on a state of the vehicle including the passenger compartment. According to this aspect, depending on the state of the vehicle, the delay time is controlled such that the listener can easily hear the speech of the human speaker. For this reason, in comparison with a case in which the delay time is maintained constant regardless of the state of the vehicle, the listener can easily hear the speech of the human speaker. For example, if the delay time is lengthened in a situation in which the noise level is increased depending on the state of the vehicle, both the sound uttered by the human speaker and the sound output from the electric loudspeaker are unlikely to coincide with a sudden and loud noise. Therefore, the listener can easily hear the human speaker's speech. If the delay time is shortened in a situation in which the noise level is decreased depending on the state of the vehicle, the shorter the time difference between the sound uttered by the human speaker and the sound from the electric loudspeaker is. Therefore, the listener or the human speaker is unlikely to feel uncomfortable about the sound from the electric loudspeaker.

In another aspect (fifteenth aspect) according to the fourteenth aspect, the state of the vehicle may be the noise level in the passenger compartment. According to this aspect, the delay time is controlled depending on the noise level in the passenger compartment such that the listener can easily hear the speech of the human speaker.

In another aspect (sixteenth aspect) according to the fifteenth aspect, the controller may lengthen the time of delay when the noise level increases. According to this aspect, both the sound uttered by the human speaker and the sound output from the electric loudspeaker are unlikely to coincide with a sudden and loud noise. Therefore, the listener can easily hear the human speaker's speech. In addition, when the noise level in the passenger compartment is low, the time difference between the sound uttered by the human speaker and the sound from the electric loudspeaker is shorter. Therefore, the listener or the human speaker is unlikely to feel uncomfortable about the sound from the electric loudspeaker.

In another aspect (seventeenth aspect) according to the fourteenth aspect, the state of the vehicle may be the speed of the vehicle. It is known that the speed of the vehicle C has a strong correlation with the noise level in the passenger compartment R. According to this aspect, it is possible to control the delay time depending on the noise level in the passenger compartment such that the listener can easily hear the speech of the human speaker.

In another aspect (eighteenth aspect) according to the seventeenth aspect, the controller may lengthen the time of delay when the speed of the vehicle increases. As the speed of vehicle increases, the noise level in the passenger compartment tends to increase. According to this aspect, the time of delay is lengthened when the speed of the vehicle increases. Therefore, both the sound uttered by the human speaker and the sound output from the electric loudspeaker are unlikely to coincide with a sudden and loud noise. Consequently, the listener can easily hear the human speaker's speech. In addition, when the speed of the vehicle C is low, the time difference between the sound uttered by the human speaker and the sound from the electric loudspeaker is shorter. Therefore, the listener or the human speaker is unlikely to feel uncomfortable about the sound from the electric loudspeaker.

In another aspect (nineteenth aspect) according to any one of the fourteenth to eighteenth aspects, the microphone may be arranged so as to correspond to one of four seats arranged in a rectangular manner, and the electric loudspeaker may be one of electric loudspeakers that are arranged so as to correspond to the four seats including a seat corresponding to the microphone and a diagonal seat that is located at a diagonal position of the seat corresponding to the microphone. This aspect may further include a supplier that supplies the sound received by the microphone to an electric loudspeaker, from among the electric loudspeakers, arranged so as to correspond to the diagonal seat. According to this aspect, the sound received by the microphone is output from the electric loudspeaker corresponding to the seat that is the most distant from the seat corresponding to the microphone. Therefore, it is possible to reduce the occurrence of howling noise during conversation. Furthermore, according to this aspect, a seat is interposed between the microphone and the electric loudspeaker. Therefore, the sound (sound waves) arriving at the seat is likely to be absorbed by the seat. As a result, it is possible to reduce the probability of occurrence of howling noise.

Another aspect (twentieth aspect) of a conversation assist apparatus includes a signal processor that generates an audio signal based on an output signal of one of microphones that are arranged so as to correspond to respective four seats arranged in a rectangular manner; and a supplier that supplies the audio signal generated by the signal processor to one of electric loudspeakers that corresponds to a diagonal seat, from among the four seats, that is located at a diagonal position of a seat corresponding to the one of the microphones.

Another aspect (twenty-first aspect) of a conversation assist apparatus includes a signal processor that generates an audio signal based on an output signal of one of microphones that are arranged so as to correspond to respective four seats arranged in a rectangular manner; and a supplier that switches, upon reception of a howling noise occurrence signal indicative of occurrence of howling noise, a destination of the audio signal generated by the signal processor from an electric loudspeaker that is a current destination of the audio signal, from among electric loudspeakers arranged so as to correspond to the respective four seats, to another one of the electric loudspeakers that is different from the electric loudspeaker, from among the electric loudspeakers, that is the current destination of the audio signal.

DESCRIPTION OF REFERENCE SIGNS

100: Conversation Assist Apparatus, 11-14: Microphone, 21-24: Electric Loudspeaker, 31-34: Signal Processor, 4: Supplier.

The invention claimed is:

1. A conversation assist apparatus for a vehicle that includes a plurality of microphones and a plurality of electric loudspeakers, each microphone of the plurality of microphones and each electric loudspeaker of the plurality of loudspeakers being arranged so as to correspond to a seat of four seats arranged in a rectangular manner in a passenger compartment of the vehicle, the conversation assist apparatus comprising:

a signal processor configured to generate an audio signal based on an output signal of a microphone of the plurality of microphones; and a supplier configured to switch, upon reception of a howling noise occurrence signal indicative of occurrence of a howling noise, a destination of the generated audio signal from an electric loudspeaker of the plurality of loudspeakers that is a current destination of the generated audio signal to another electric loudspeaker of the plurality of electric loudspeakers that is different from the electric loudspeaker that is the current destination of the generated audio signal.

2. The conversation assist apparatus according to claim 1, further comprising a detector configured to output the howling noise occurrence signal upon detecting the howling noise, wherein the supplier is configured to receive the howling noise occurrence signal from the detector.

3. The conversation assist apparatus according to claim 1, further comprising:

a manipulation switch; and an outputter configured to output the howling noise occurrence signal in response to a manipulation of the manipulation switch, wherein the supplier is configured to receive the howling noise occurrence signal from the outputter.

* * * * *